United States Patent [19]

Berion et al.

[11] Patent Number: 5,073,032

[45] Date of Patent: Dec. 17, 1991

[54] MIXING DEVICE FOR BULK IMPREGNATION OF PARTICULATE MATTER BY A BINDER

[75] Inventors: Roland Berion, Nods; Dominique Garnier, Poissy, both of France

[73] Assignee: Efisol, Paris, France

[21] Appl. No.: 620,647

[22] Filed: Nov. 30, 1990

[30] Foreign Application Priority Data

Nov. 20, 1989 [FR] France ..... 89 15170

[51] Int. Cl.[5] ..... B01F 5/04

[52] U.S. Cl. ..... 366/168; 118/56; 118/308; 366/174; 366/175

[58] Field of Search ..... 366/178, 177, 180, 181, 366/182, 168, 169, 170, 172, 173, 174, 175, 54, 33, 34, 154, 155; 118/52, 56, 308

[56] References Cited

U.S. PATENT DOCUMENTS

| | | | |
|---|---|---|---|
| 1,741,176 | 12/1929 | Wilder | 366/178 |
| 2,596,220 | 5/1952 | Dodds | 366/178 |
| 2,658,049 | 11/1953 | Adams | 366/180 |
| 2,953,359 | 9/1960 | Mau | 366/172 |
| 3,295,838 | 1/1967 | Ban | 366/114 |
| 3,912,231 | 10/1975 | Weber | 366/183 |

*Primary Examiner*—Robert W. Jenkins

*Attorney, Agent, or Firm*—Marvin E. Jacobs

[57] ABSTRACT

A device for mixing particulate matter and liquids comprises a rotatable central shaft passing through a stationary particle feed hopper and supporting a perforated rotatable plate and incorporating a liquid feed conduit terminating at an atomizer, a spray chamber, a rotating assembly linked to the rotating plate and made up by an agitator located below said spray chamber and by a conically-shaped particle catching and spreading tray which discharges the coated particles into a mixing chamber fitted with blades and rotating in the opposite direction to the said rotating assembly, whereby excellent bulk impregnation of said particulate matter is obtained.

6 Claims, 1 Drawing Sheet

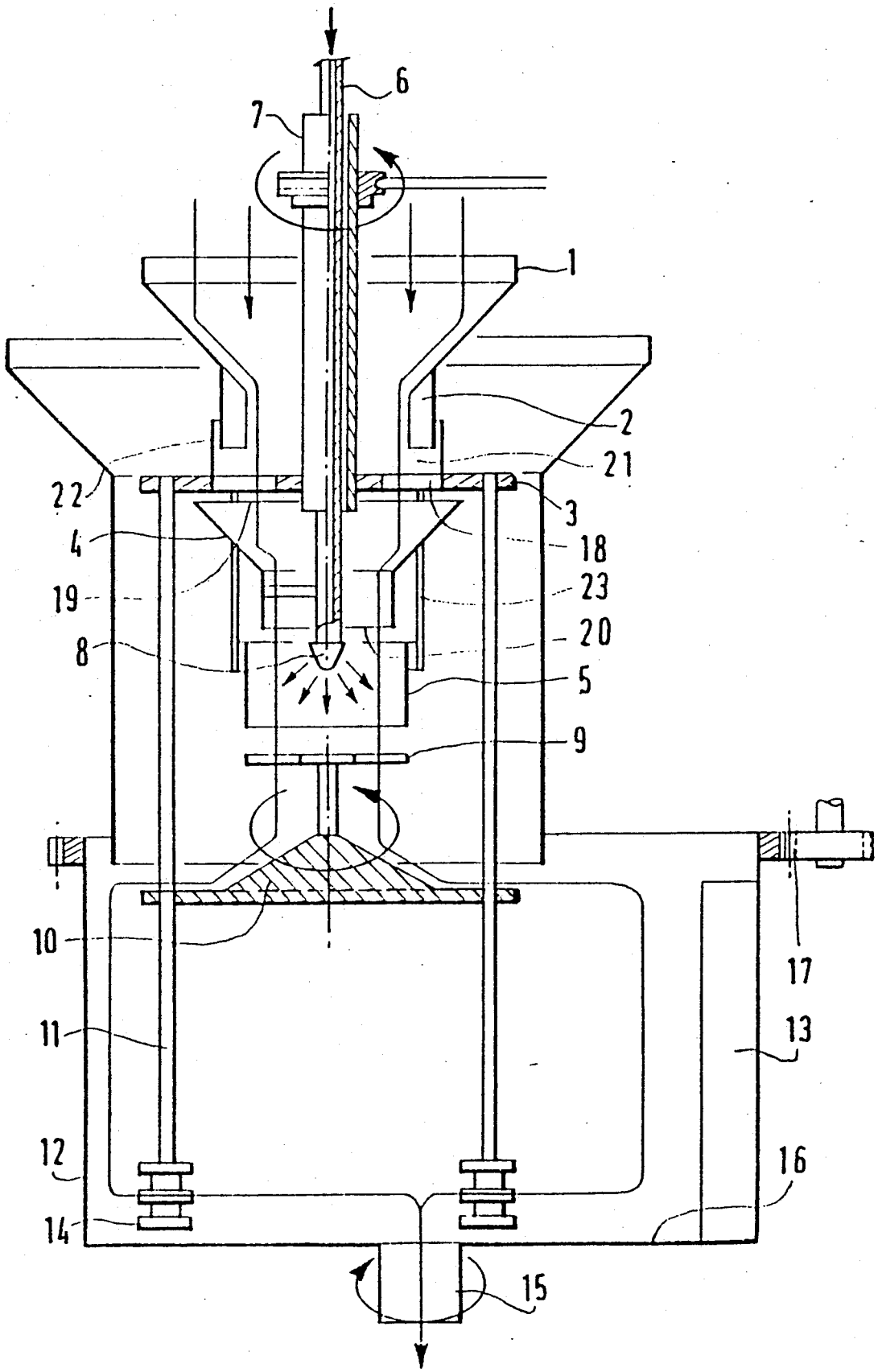
6
7
1
2
21
22
3
4
18
19
23
20
8
5
9
10
17
11
13
12
16
14
15

MIXING DEVICE FOR BULK IMPREGNATION OF PARTICULATE MATTER BY A BINDER

BACKGROUND OF THE INVENTION

The present invention relates to a mixer for mixing particles with liquids, and more particularly to a mixer that ensures uniform coating of all the particles by a binder.

A large variety of particle-liquid mixers or blenders already exist, but these are not entirely satisfactory when there is a need to promote a sufficiently intimate contact between particles of exfoliated rock, such as vermiculite, and an inorganic or mineral binder, such as an alkaline silicate, in order to ensure all the particles are uniformly coated, the coated particles then being employed in applications such as the production of uniform density decorative panels.

SUMMARY OF THE INVENTION

The invention provides a mixing device for use in particular for bulk impregnation of vermiculite by an inorganic binder, the device comprising a rotatable shaft passing through a stationary particle feed hopper, the said shaft supporting a perforated rotatable plate and having a liquid feed conduit terminating in an atomizer passing therethrough, a spray chamber into which said atomizer discharges, and a rotating assembly made up by an agitator located below the spray chamber and by a conically-shaped particle catching and spreading tray.

In accordance with a preferred embodiment, the rotating assembly made up by the agitator and by a conically-shaped particle catching and spreading tray is joined to the perforated rotatable plate by means of suspension arms in order to rotate therewith.

In accordance with a further preferred embodiment, the said conically-shaped particle catching and spreading tray is located inside a mixing chamber carrying at least one blade on the inner surface thereof and which is driven in rotation in the opposite direction to that of the said rotating assembly.

In accordance with a preferred embodiment, the suspension arms joining the conically-shaped particle catching and spreading tray to the perforated rotatable plate are extended by fingers right down to a position close to the base of the mixing chamber, the said fingers being adapted to evacuate the liquid-coated particles deposited on said base of the chamber towards a discharge outlet in said base which is located eccentrically with respect to said rotatable shaft.

In accordance with a further preferred embodiment, a funnel-shaped transfer conduit is provided below the said perforated rotatable plate and terminating just above the said spray chamber, the diameter of the mouth of said funnel-shaped transfer conduit corresponding to the diameter of the perforated portion of said plate and the diameter of the lower outlet of which substantially corresponds to the diameter of said spray chamber The feed hopper can include at least one vane at its lower portion, this vane penetrating into a distribution chamber which is defined above the perforated portion of said perforated rotatable plate by a wall which is closed on itself and projects above said perforated plate in order to oblige the particles to pass through the perforations.

Further details of the invention will become more clear from the description that follows of a preferred embodiment of the mixer according to the invention.

BRIEF DESCRIPTION OF THE DRAWING

The drawing shows a cross-sectional view of a preferred embodiment of the mixer.

DETAILED DESCRIPTION OF A PREFERRED EMBODIMENT

The upper part of the mixer is carried in a housing and includes a charging cone or hopper 1 through which a rotatable shaft passes, a liquid feed conduit 6 being provided running along the axis of the shaft. The rotatable shaft 7 is integral with a plate 3 having a central perforated portion, suspension arms 11 being fixed to the plate The outer wall of the hopper 1 carries vanes 2 on its vertical lower part which encourage the particulate matter to pass through the perforations in the plate 3, as explained below.

The lower end of the liquid flow conduit 6 takes the form of an atomizer 8 which is located inside a spray chamber 5. A funnel-shaped transfer conduit 4 is arranged between the perforated plate 3 and the spray chamber 5 and the diameter of the entry 19 to this funnel-shaped transfer conduit is substantially the same as the diameter of a portion 18 of plate 3 that carries the perforations, the diameter of the flow leaving the perforations 18 of the plate 3 hence being constricted and reduced to the diameter of the spray chamber.

The external vanes 2 on the hopper 1 preferably penetrate into a particle distribution chamber 21 which is defined by a closed continuous wall 22 of generally circular shape projecting above the perforated plate 3 in order to stir and agitate the particles that are deposited on the plate and to force them to pass through the perforations 18 and become divided into a plurality of parallel rotating flow lines within the funnel-shaped transfer conduit 4. The spray chamber 5 and the funnel-shaped transfer conduit 4 are normally carried by the perforated plate 3, for example by means of support columns or sleeves 23, but for certain applications it would also be possible to support them by a suitably reinforced flow conduit 6 so that the funnel-shaped transfer conduit 4 and the chamber 5 would be stationary, and not rotating as described here, in the mixer.

Below the spray chamber 5, an agitator 9 is provided and this is integral with a particle catching and spreading tray 10 having an upper sloping generally conical-shaped surface which keeps the impregnated particles separate and prevents caking, and the agitator and tray, together with the arms 11 form an assembly which is driven in rotation by the shaft 7. The conical-shaped particle catching and spreading tray 10 is arranged inside a mixing chamber 12 the base 16 of which carries a discharge opening 15 which is arranged eccentrically with respect to the rotatable shaft 7. This mixing chamber 12 which carries blades 13 on its inner wall is driven, by means of a transmission system 17 linked to a drive motor, in the opposite direction to the direction of rotation of shaft 7. The arms 11 are extended down to a position close to the base 16 of chamber 12 by fingers 14 designed to evacuate the liquid-coated particles deposited on the base 16 towards the discharge opening 15.

The exfoliated vermiculite or other similar granular or particulate material is introduced into the mixer through the charging cone or hopper 1 so that the particles or granules become regularly dispersed over the rotating plate 3. The passage of the particles through the perforations 18 under the stirring and agitating influence of the vanes 2 increases the swirling motion of the individual particles which was already initiated by the rotation of the perforated plate 3. The flow of particles is then channeled by the funnel-shaped transfer conduit 4 in order to concentrate into the spray chamber 5.

The liquid binder is fed under pressure into the conduit 6 and is put into spray form by the atomizer 8 ready to intermingle intimately with the cloud of swirling particles or granules inside the spray chamber 5 The swirling motion imparted on the particles particularly encourages intimate contact between the atomized liquid binder and the particles.

The binder-coated particles are then slightly stirred by the agitator 9 before encountering the conically-shaped particle catching and spreading tray 10 which is driven by the arms 11 integral with plate 3.

The conically-shaped particle catching and spreading tray 10 distributes the particles in the mixing chamber 12 where they are subject to the action of centrifugal force. The chamber 12 is itself rotating in the opposite direction to the rotating assembly which is integral with the shaft 7. The opposite directions of rotation of the suspension arms 11 and the blades 13 greatly favors stirring and ensures the particles leaving the chamber are uniformly impregnated with binder.

Under the scraping effect of the fingers 14, the binder-coated particles are guided towards the eccentrically-located discharge opening 15 in order to ease their evacuation or fall to an installation typically requiring a constant supply of such particles.

It should be finally mentioned that all the mixing surfaces which are in contact with the particles are preferably coated with a material which prevents sticking and the build-up of deposits.

What we claim is:

1. A device for mixing particulate matter and liquids comprising a rotatable shaft passing through a stationary particle feed hopper, the said shaft supporting a perforated rotatable plate and having a liquid feed conduit terminating in an atomizer passing therethrough, a spray chamber into which said atomizer discharges, and a rotating assembly made up by an agitator located below the spray chamber and by a conically-shaped particle catching and spreading tray.

2. Mixing device according to claim 1, wherein said rotating assembly made up by the agitator and by a conically-shaped particle catching and spreading tray is joined to said perforated rotatable plate by means of suspension arms in order to rotate therewith.

3. Mixing device according to claim 1, wherein said conically-shaped particle catching and spreading tray is located inside a mixing chamber carrying at least one blade on the inner surface thereof and which is driven in rotation in the opposite direction to that of the said rotating assembly.

4. Mixing device according to claim 3, wherein said suspension arms joining the conically-shaped particle catching and spreading tray to the perforated rotatable plate are extended by fingers right down to a position close to the base of said mixing chamber, the said fingers being adapted to evacuate the liquid-coated particles deposited on said base of the chamber towards a discharge outlet in said base which is located eccentrically with respect to said rotatable shaft.

5. Mixing device according to claim 1, wherein a funnel-shaped transfer conduit is provided below the said perforated rotatable plate and terminates just above the said spray chamber, the diameter of the mouth of said funnel-shaped transfer conduit corresponding to the diameter of the perforated portion of said plate and the diameter of the lower outlet of which substantially corresponds to the diameter of said spray chamber.

6. Mixing device according to claim 1, wherein the said feed hopper includes at least one vane at its lower portion, said vane penetrating into a distribution chamber which is defined above the perforated portion of said perforated rotatable plate by a wall which is closed on itself and projects above said perforated plate in order to oblige the particles to pass through the perforations.

* * * * *